US005516405A

United States Patent [19]

De Witt

[11] Patent Number: 5,516,405

[45] Date of Patent: May 14, 1996

[54] RETENTION AIDS

[75] Inventor: James A. De Witt, Burnaby, Canada

[73] Assignee: MacMillan Bloedel Limited, Vancouver, Canada

[21] Appl. No.: 152,031

[22] Filed: Sep. 20, 1993

[51] Int. Cl.[6] ..... D21H 21/10

[52] U.S. Cl. ..... 162/164.1; 162/163; 162/164.3; 162/165; 162/181.1

[58] Field of Search ..... 162/163, 165, 162/168.1, 164.1, 164.3, 181.1

[56] References Cited

U.S. PATENT DOCUMENTS

| | | | |
|---|---|---|---|
| 4,070,236 | 1/1978 | Carrard et al. | 162/165 |
| 4,313,790 | 2/1982 | Pelton et al. | 162/163 |
| 5,173,208 | 12/1992 | Chung et al. | 162/168.1 |

OTHER PUBLICATIONS

Casey, *Pulp & Paper*, vol. III, (1981) p. 1564.

*Primary Examiner*—Peter Chin

*Attorney, Agent, or Firm*—C. A. Rowley

[57] ABSTRACT

First pass filler retention is obtained by adding a cationic fixative into a filler containing pulp slurry which is also treated using the conventional polyethylene oxide/promoter retention system and as a result a significant increase in the first pass retention of filler is attained.

4 Claims, 2 Drawing Sheets

RETENTION AIDS

FIELD OF THE INVENTION

Present invention is for retention aids for papermaking, more particularly, the present invention relates to an improved polyethylene oxide/promoter retention system.

1. Background of the Present Invention

There are numerous different systems of aiding retention of fillers (organic and inorganic) such as calcium carbonate, clay, etc. For example, it is known to treat the paper making slurry with polyethylene oxide and a promoter such as phenol formaldehyde, naphthalene sulphonate, black liquor, etc. to improve the retention of fillers in the paper being produced.

It is also well known to use fixatives, particularly cationic fixatives such as polyethylene amide or small polymers such as poly-dialyl-dimethyl ammonium chloride (poly-DADMAC), polyethylene amides or modified polyamides, polyethylene imines, aluminum sulphonate (Alum) or polyaluminum chloride, etc to increase the retention of fillers in paper.

Cationic fixatives have also been used in conjunction with other additives in combined retention aid systems. The role of the cationic fixative in these combined systems varies according to the nature of the other additives. In some systems, the cationic fixative acts as a scavenger of interfering anionic contaminants, so as to protect the cationic sites of a subsequent component. In other applications, the cationic fixative is added to reverse the charge on the solid phase of the papermaking furnish, thus, enabling flocculation and retention by subsequent addition of an anionic polymer.

2. Brief Description of the Present Invention

It is an object of the present invention to provide an improved polyethylene oxide (PEO)/promoter filler retention system for making paper.

The present invention relates to a method of improving the first pass filler (ash) retention of a papermaking slurry comprising adding a filler to said slurry, adding a cationic fixative to said slurry, providing a promoter in said slurry and screening said slurry, then adding polyethylene oxide to said slurry after screening has been completed and then forming said slurry containing said filler, said cationic fixative, said promoter and said polyethylene oxide into a sheet on a papermaking machine to increase the amount of first pass retention of said filler in said sheet.

Preferably, said cationic fixative will be added to said slurry in an amount of 0.01 to 1% by weight based on the dry weight of fibres in said slurry.

Preferably, said polyethylene oxide will be applied to said slurry in the amount of 40 to 300 grams by weight based on a tone dry weight of said fibres in said slurry.

Preferably said promoter will be provided in said slurry by the addition of phenol formaldehyde resin, black liquor or naphthalene sulphonate.

Preferably, said promoter will be phenol formaldehyde resin and will be added to said slurry in the ratio of 1:1 to 1:3 phenol formaldehyde resin to polyethylene oxide on a dry weight basis.

Preferably, said filler will be an inorganic filler selected from a group consisting of calcium carbonate, clay, titanium dioxide ($TiO_2$), precipitated aluminum silicates, silicates, talc, precipitated aluminas, and plastic pigments such as urea formaldehyde.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Practising the present invention, a pulp slurry containing a filler in the amount required to provide the required properties (optical, printing and/or cost) to the sheet being produced will be treated with a cationic fixative of the type generally used in the trade which include, as above described, polyethylene amide or small polymers such as poly-dialyl-dimethyl ammonium chloride (poly-DADMAC), polyethylene amides or modified polyamides, polyethylene imines, aluminum sulphonate (Alum) or polyaluminum chloride, etc.

The filler used will preferably be any suitable filler which will normally include calcium carbonate, clay, titanium dioxide ($TiO_2$), precipitated aluminum silicates, silicates, talc, precipitated aluminas, and plastic pigments such as urea formaldehyde which will be of a particle size and be added in an amount to obtain the desired characteristics in the finished sheet of paper. The preferred fillers are calcium carbonate and clay and will normally be added at the fan pump.

Figure 3:
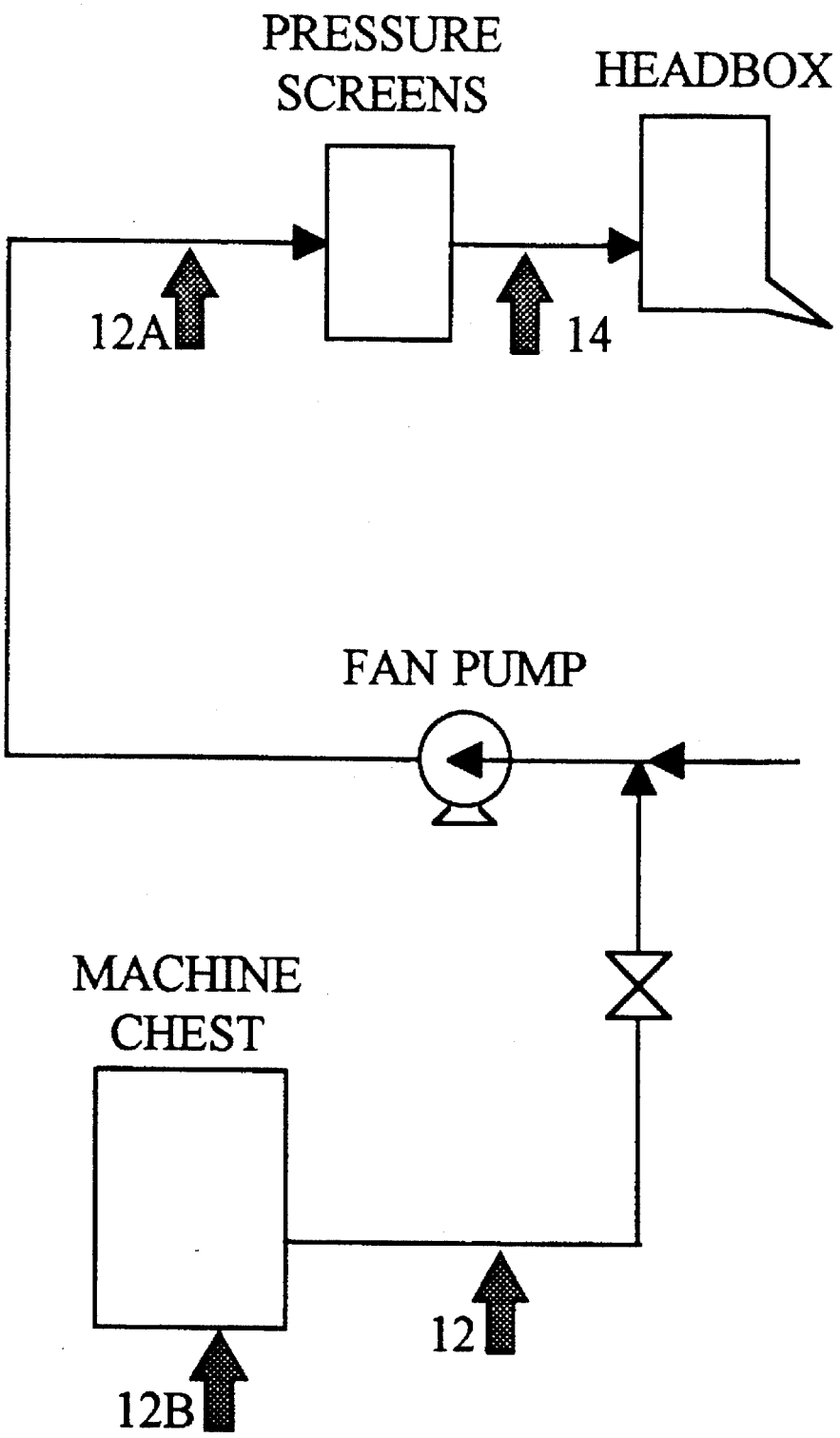
FIG. 3 is a flow diagram of the present invention schematically showing the points of additive addition.

The cationic fixative is preferably added to the pulp between the machine chest and the last screens (as shown at 12, 12A and/or 12B in FIG. 3) and will normally be added after the filler.

The promoter used and the amount of promoter added will depend on the pulp furnish used to make the paper. As above indicated, promoters that may be added to the furnish include phenol formaldehyde, naphthalene sulphonate, black liquor, etc. However, with some furnishes the promoter will be inherent in the stock or furnish and need not be added for example the promoter may be part of the fibre composition i.e. ground wood in the furnish provides a source of a suitable promoter. Generally when a promoter is added it will be added at the fan pump or in any event before the screens.

The polyethylene oxide is added to the slurry after the screening operations are completed and before the slurry is applied to the forming wire (as shown at 14 in FIG. 3) i.e. before the slurry is formed into a sheet and is added in an amount of 40 to 300 grams by weight based on the dry weight of said fibres in the slurry or furnish.

The preferred promoter will be the conventional phenol formaldehyde resin used in retention systems in the pulp and paper industry and will be applied to the pulp slurry in a conventional manner at a conventional location which is generally as above indicated at the fan pump and in any event, normally, before the screens. The amount of phenol formaldehyde applied is the conventional amount that is normally used for the amount of filler being applied, i.e.

generally in the ratio of phenol formaldehyde to polyethylene oxide of 1:1 to 1:3 weight on weight basis.

EXAMPLE

The effectiveness of the present invention is demonstrated by tests that were conducted applying varying amounts of a specific cationic fixing agent, namely, a modified polyethylene imine sold by BASF under the tradename Polymin SK™, and used in conjunction with a polyethylene oxide/phenol formaldehyde resin (PEO/PF) system using various dosages of PEO/PF resin.

Figure 1:
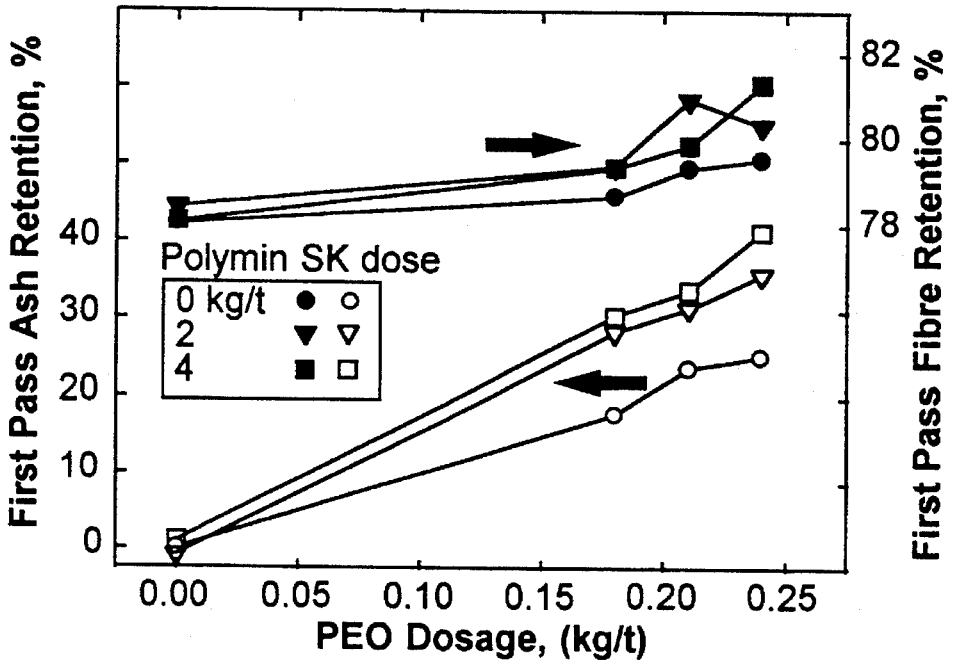
FIG. 1 shows graphs of first pass ash retention (filler retention) versus polyethylene oxide dosage and a similar graph of first pass fibre retention versus polyethylene oxide dosage based on Britt Jar tests.
Figure 2:
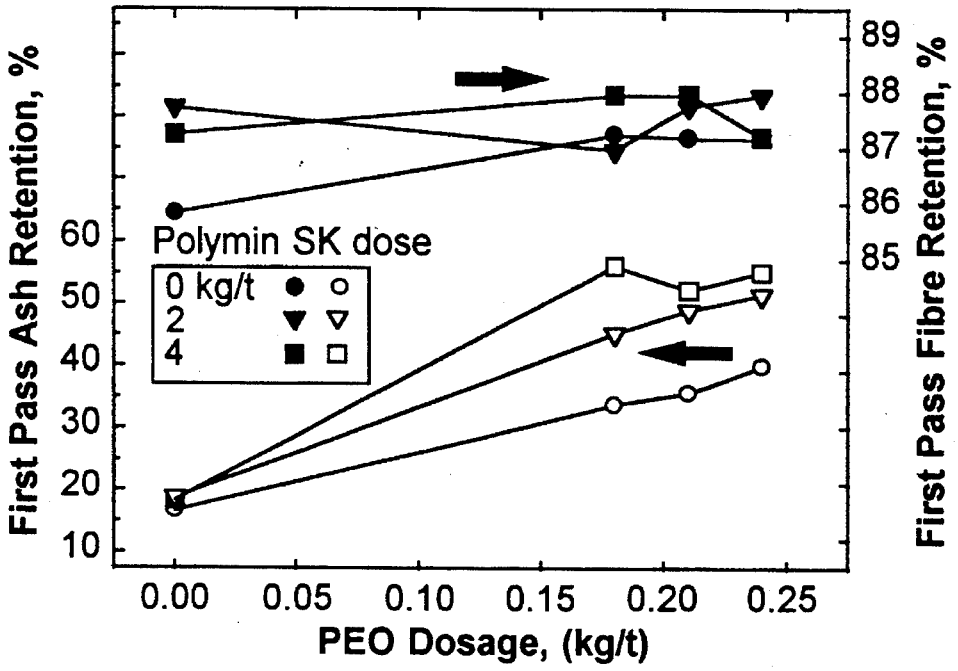
FIG. 2 shows graphs similar to those of FIG. 1 but based on MK Sheet Former tests.

In the examples illustrated by the graph of FIGS. 1 and 2, a papermaking slurry containing a mixture of 15% semi-bleached kraft and 85% a mixture of groundwood and CTMP fibres (the mixture containing 60% weight percent CTMP) and containing 10% based on the dry weight of the fibres of an inorganic filler, namely, calcined clay having an average particle size of about 2 microns was tested The first pass retention was established based on the standard Britt Jar retention determining procedure and the results are plotted in FIG. 1 wherein the circles represent 0% Polymin SK, the triangles 2% Polymin SK and the squares 4% Polymin SK (% given are the % by weight of the Polymin SK applied to the pulp based on the dry weight of the fibres in the slurry), the solid (filled-in) circles, triangles and squares designate first pass fibre retention whereas the open circles, triangles and squares represent ash retention (filler retention). The first pass retention based on the MK Sheet Former test are plotted in FIG. 2 using the same symbols to represent the same parameters as defined above for FIG. 1.

The % retention reported in the graphs of FIG. 1 and 2 are based on the ratio of the consistency in % of clay (or fibres) in the drainage to the consistency % of clay (or fibres) in the furnish of slurry being tested.

It will be apparent that the filler retention increases with the amount of polyethylene oxide (PEO) dosage up to about 20 whereas with a mild dosage of polyamine of 2 kg per tonne pulp oven dried, the retention increased about 50% and as the amount of polyamine was increased to 4 kg per tonne, the first pass filler retention increased to 40.

It will also be noted that the fines retention did increase slightly, i.e. the total fibre retention increased by approximately, 1 to 2%, thus, there is a very significant increase in filler retention with very little change in fibre retention.

It will be apparent that there are major advantages in first pass filler retention to be obtained using the present invention over that obtained using the conventional system of polyethylene oxide/promoter (phenol formaldehyde resin) without a significant change in first pass fiber retention.

Having described the invention, modifications will be evident to those skilled in the art without departing from the scope of the invention as defined in the appended claims.

I claim:

1. A method of improving the first pass filler retention of a papermaking pulp slurry comprising adding a filler to said slurry, providing at least 0.01% based on the weight of said pulp in said slurry of an organic cationic fixative in said slurry, said organic fixative being selected from the group consisting of polyethylene amides, poly-dialyl-dimethyl amonium chlorides, polyethylene imines, providing a promoter consisting of phenol formaldehyde resin, in said slurry and screening said slurry, then adding polyethylene oxide to said slurry after said screening has been completed said phenol formaldehyde and polyethylene oxide being present in the range of ratios of 1 to 1 to 1 to 3 by weight and said polyethylene oxide being present in the range of between 40 and 300 grams per tonne of dry pulp in said slurry, and then forming said slurry containing said filler, said cationic fixative, said promoter and said polyethylene oxide into a sheet on a papermaking machine to increase the amount of first pass retention of said filler in said sheet.

2. A method as defined in claim 1 wherein said cationic fixative is added to said slurry in an amount of 0.01 to 1% by weight based on the dry weight of fibres in said slurry.

3. A method as defined in claim 1 wherein said filler is an inorganic filler selected from a group consisting of calcium carbonate, clay, titanium dioxide ($TiO_2$), precipitated aluminum silicates, silicates, talc, precipitated aluminas, and plastic pigments.

4. A method as defined in claim 2 wherein said filler is an inorganic filler selected from a group consisting of calcium carbonate, clay, titanium dioxide ($TiO_2$), precipitated aluminum silicates, silicates, talc, precipitated aluminas, and plastic pigments.

* * * * *